US007607651B2

(12) United States Patent
Kuwata et al.

(10) Patent No.: US 7,607,651 B2
(45) Date of Patent: Oct. 27, 2009

(54) SHEET PROCESSING APPARATUS AND IMAGE FORMING APPARATUS

(75) Inventors: Takashi Kuwata, Sunto-gun (JP); Kenichiro Isobe, Sunto-gun (JP); Yasuyoshi Hayakawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/962,487

(22) Filed: Dec. 21, 2007

(65) Prior Publication Data

US 2008/0175639 A1 Jul. 24, 2008

Related U.S. Application Data

(63) Continuation of application No. 11/058,204, filed on Feb. 16, 2005, now Pat. No. 7,341,248.

(30) Foreign Application Priority Data

Feb. 20, 2004 (JP) ..... 2004-044842
Feb. 4, 2005 (JP) ..... 2005-029216

(51) Int. Cl.
*B65H 37/04* (2006.01)

(52) U.S. Cl. ..... 270/58.11; 270/58.01; 270/58.07; 270/58.08

(58) Field of Classification Search ..... 270/58.01, 270/58.07, 58.08; 399/407, 408, 410
See application file for complete search history.

(56) References Cited

U.S. PATENT DOCUMENTS 5,342,034 A 8/1994 Mandel et al.
5,478,061 A * 12/1995 Murakami et al. ..... 270/58.08
5,622,359 A * 4/1997 Kawano et al. ..... 270/58.12
6,286,830 B1 9/2001 Kitahara et al.
6,341,772 B1 1/2002 Waragai et al.
6,352,253 B1 3/2002 Hayakawa et al.

(Continued)

FOREIGN PATENT DOCUMENTS

JP 2003-246546 A 9/2003

*Primary Examiner*—Gene Crawford
*Assistant Examiner*—Lesie A Nicholson, III
(74) *Attorney, Agent, or Firm*—Fitzpatrick, Cella, Harper & Scinto

(57) ABSTRACT

The object of the present invention is to provide a sheet processing apparatus for passing sheets between an upper jaw and a lower jaw of a binder that is fixed on a intermediate stacking portion and stapling the ends of the sheet, wherein binding processing is possible for a large number of sheets and the problems of paper jams due to inclining or poor alignment are solved and which has a small size, is low in cost and is highly reliable. In order to achieve the above object, a typical configuration of the sheet processing apparatus of the present invention comprises: a conveyance portion which conveys sheets; an intermediate stacking portion which temporarily stacks sheets conveyed from the conveyance portion; and a binder which performs a binding process for binding the sheets stacked in the intermediate stacking portion, and the binder is fixed at one side of the intermediate stacking portion and the sheet which is conveyed from the conveyance portion passes the opening of the binder and is stacked in the intermediate stacking portion; the conveyance portion comprises a plurality of drive rollers in the direction that intersects the conveyance direction; and the drive rollers other than the drive roller that is closest to the binder form conveyance roller pairs with driven rollers.

5 Claims, 12 Drawing Sheets

U.S. PATENT DOCUMENTS 6,561,503 B1 * 5/2003 Ogata et al. ..... 270/58.12
6,634,641 B2 * 10/2003 Yamakawa et al. ..... 271/220
6,698,745 B2 3/2004 Saito
6,705,603 B1 * 3/2004 Kirino et al. ..... 270/12
6,722,646 B2 4/2004 Sekiyama et al.
6,735,415 B2 5/2004 Isobe et al.
7,207,556 B2 * 4/2007 Saitoh et al. ..... 270/58.08
2002/0109283 A1 8/2002 Hasegawa et al.
2002/0163120 A1 11/2002 Yamada et al.
2003/0020227 A1 1/2003 Saito
2003/0057625 A1 3/2003 Kuwata et al.
2003/0215276 A1 11/2003 Ata et al.
2003/0219295 A1 * 11/2003 Saitoh et al. ..... 399/410

* cited by examiner

SHEET PROCESSING APPARATUS AND IMAGE FORMING APPARATUS

This application is a continuation of U.S. patent application Ser. No. 11/058,204, filed Feb. 16, 2005.

BACKGROUND OF THE INVENTION

1. Field of the Invention

The present invention relates to a sheet processing apparatus performing a sheet binding process and an image forming apparatus in which this sheet processing device is installed. The invention relates in particular to a sheet processing apparatus which can solve the problems of paper jamming and alignment defects for a binding operation and an image forming apparatus in which this sheet processing apparatus is installed.

2. Description of the Related Art

In the past, a sheet processing apparatus has been provided which performs aligning, binding by stapling, bending, and spine attachment (these processes together being sometimes called book making) for a plurality of sheets (a sheet bundle) on which images have been formed. In the past, there were many of the large console type sheet processing apparatus (a stationary unit that is separate from the image forming apparatus), but in recent years there has been demand for small sheet processing apparatus which is detachably attachable to the upper portion of a small or medium size image forming apparatus.

One example of this type of small sheet processing apparatus is that described in Japanese Patent Application Laid-Open No. 2003-246546 (Patent Document 1). In this apparatus, the space for movement of the stapler is eliminated by fixing the stapler, which is an example of a binding means, on the intermediate stacking portion, and the sheets are stacked and aligned at the opening of the stapler or in other words, between the driver (the metal plate that punches out the staples) and the clincher (the bending plate) and the end of the bundle of sheets is thereby stapled.

In this type of sheet processing apparatus, when the sheets are stacked in the intermediate stacking portion, because the sheets pass the opening of the stapler, the sheet aligning distance is short and the aligning time is also short. Also, there is no need to lead the sheet bundle to be stapled to the opening of the stapler after the sheets are aligned, and thus the situation does not occur where a curled sheet end contacts the stapler and causes a stapling error. Furthermore, because a mechanism for leading the sheet bundle to the stapler becomes unnecessary, there is the advantage that the apparatus may become more compact and the cost may be reduced.

In the sheet processing apparatus having the above-described structure, in order to make it possible to process a large number of sheets, the height of the sheet bundle must be increased and stacking must be possible even when there is curling. Thus, the height of aligning member must be increased and the possible stacking height of the intermediate stacking portion must also be increased. As a result, the nip position of the roller pair that conveys sheets to the intermediate stacking portion from the sheet stacking surface of the intermediate stacking portion must also be made high.

Meanwhile, as described above, the sheet bundle must be conveyed to the opening of the stapler (between the driver and the clincher) and aligned. However, while the possible stacking height of the intermediate stacking portion takes into consideration curling of the sheet and is set such that there is some leeway with the height, the height of the opening of the stapler is set with the thickness of the sheet bundle after being bound in accordance with the binding process capability of the stapler (the number of sheets that can be bound) as a reference. If the opening of the stapler is set with extra height, the stroke of the driver for binding processing will increase and corresponding strength is required and thus the apparatus becomes large. In addition, the binding processing time is increased because the stroke of the driver from the home position to the binding position is increased. Thus, in the case where a stapler which is a binder that is small in size and has high processing efficiency is used, there is a limitation in that the opening cannot be placed too high. Consequently, there is need to increase the possible stacking height of the intermediate stacking portion and at the same time, provide a guide means for guiding the sheet to the opening of binder that has a limited height.

Because the stapler is fixed at one side of the intermediate stacking portion, the guiding means is disposed at the same side (in the vicinity of the stapler) and it guides the sheet at position lower than that of the other conveyance surfaces. As a result, the conveyance resistance is larger in the vicinity of the stapler than at the other conveyance surface. When the conveyance resistance of the guide means increases and the conveyance speed is reduced in this manner, lack of uniformity in the conveyance speed in the both sides of the width direction of the sheet which intersects the conveyance direction occurs and this results in slanting which sometimes causes paper jams. Furthermore, because the sheets are sometimes slant stacked at the time of stacking in the intermediate stacking portion and the means does not manage to completely align the sheets, there is the problem that binding processing may be done without sufficient alignment. A problem of this kind is especially apparent with a thick, rigid sheet.

SUMMARY OF THE INVENTION

As a result of this problem, an object of the present invention is to provide a sheet processing apparatus which passes sheets between an upper jaw (driver or clincher) and lower jaw (clincher or driver) of a binder, an example of which includes a stapler, that is fixed on a intermediate stacking portion and subjects an end of the sheet to a binding process, wherein binding processing is possible for a large number of sheets and the problems of paper jams due to slanting or poor alignment are solved and the apparatus has a small size, is low in cost and is highly reliable.

In order to achieve the above objects, a typical configuration of the sheet processing apparatus of the present invention comprises: a conveyance portion which conveys sheets; an intermediate stacking portion which has a sheet stacking surface at a lower position than the conveyance portion and which temporarily stacks sheets conveyed from the conveyance portion; and a binder in which an opening formed between an upper jaw and a lower jaw opposes the conveyance portion and in which one of the upper jaw and the lower jaw is swung to perform a binding process for binding the sheets stacked in the intermediate stacking portion, and the binder is positioned at one side in the direction which intersects the sheet conveyance direction of the intermediate stacking portion, such that the sheet which is conveyed by the conveyance portion passes the opening of the binder and is stacked in the intermediate stacking portion; the conveyance portion comprises a guide for guiding the end of the sheet towards the opening of the binder and a plurality of drive rollers that are disposed in the direction intersecting the sheet conveyance direction and which contact the sheet upper surface; and the drive rollers other than the drive roller that is closest to the binder form conveyance roller pairs with driven rollers.

According to the present invention, in the sheet processing apparatus for passing sheets between a driver and a clincher of a stapler that is fixed to an intermediate stacking portion and stapling the an end of the sheets, the problems of paper jams due to advancing on an incline or poor alignment are solved and a stapling apparatus in which binding process is possible for a large number of sheets is provided which has a small size, is low in cost and is highly reliable.

DETAILED DESCRIPTION OF THE EMBODIMENT

Embodiment 1

An embodiment of the sheet processing apparatus and the image forming apparatus of the present invention is described using the drawings.

(Overall Structure)

Figure 1:
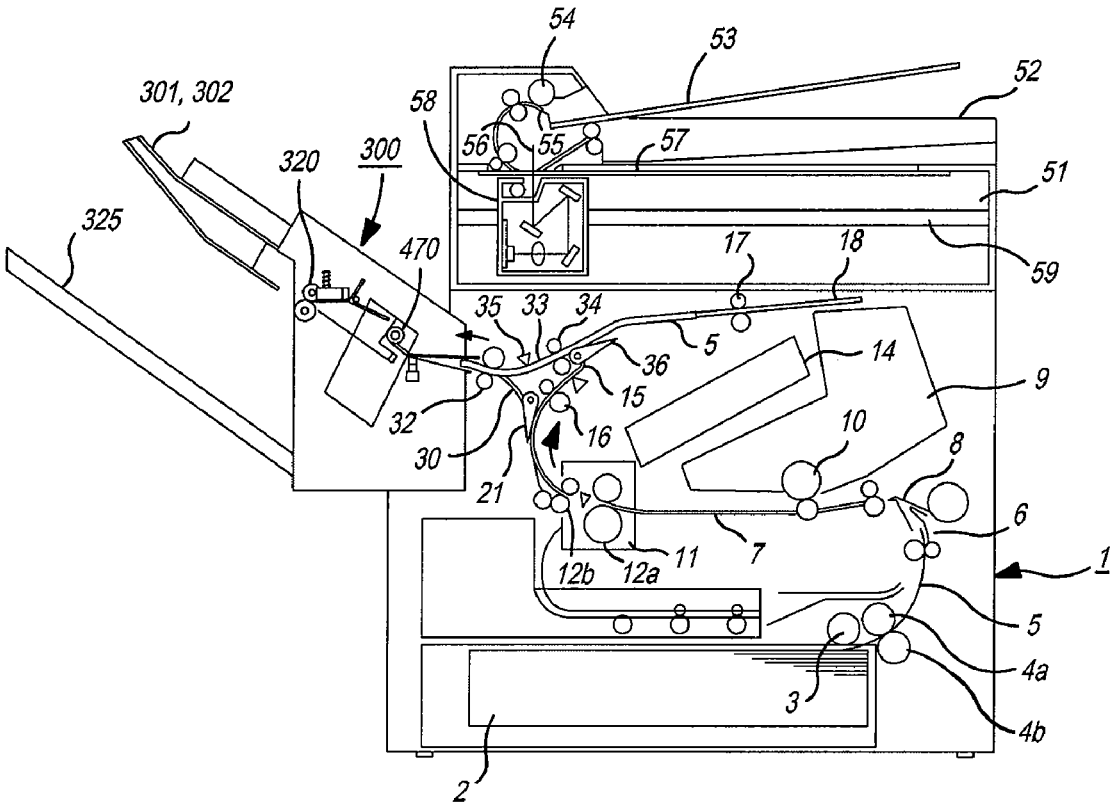
FIG. 1 is cross-sectional view for describing the overall structure of the image forming apparatus.

First, the overall structure of the image forming apparatus will be described. FIG. 1 is a cross-sectional view for describing the overall structure of the image forming apparatus.

FIG. 1 shows the image forming apparatus 1 which is a copying machine that includes an image reading portion as an example. The lower part of the apparatus has a feeding cassette 2 constituting a sheet feeding portion, a feeding roller 3 for feeding sheets from the feeding cassette 2, and separating conveyance rollers 4*a* and 4*b* for separating the sheets that have been fed one sheet at a time. The sheets that are fed out from the sheet feeding portion are conveyed to the image forming portion by the conveyance paths 5, 6, and 7 and the registration roller 8. The image forming portion comprises an image forming processing unit (called cartridge 9 hereinafter) which has a photosensitive drum 10 or the like. In this embodiment, image exposure is performed from the scanner 14 to the photosensitive drum 10, and a toner image is formed by a known electrophotographic method, and this toner image is transferred to the sheet that has been conveyed. After the sheet on which images have been formed is heated and subjected to pressure in the heat-fixing apparatus 11, and the toner image is fixed, the sheet is discharged to the sheet processing apparatus 300, which is described hereinafter, by the fixing and discharge roller pair 12 and discharge roller pair 32 which form the discharge means.

The image reading portion is disposed above the image forming apparatus 1. As shown in FIG. 1, the image reading portion comprises a scanner unit 51 and an ADF52 (Auto Document Feeder). The ADF52 separates and conveys the plurality of sheets stacked on the document tray 53 one at a time using the feed roller 54 and the separation pad 55, and the information on the document is optically read by passing the document reading position 56. Also, the ADF52 may open and close on a hinge (not shown) at the rear of the apparatus, and is opened and closed when a thick document is stacked on the platen glass 57. In the scanner portion 51, the optical carriage 58 scans the document loaded on the platen glass 57 in the horizontal direction along the guide axle 59 and reads information on the document. It is thus a typical apparatus which does photoelectric conversion using CCD. When the document is read by ADF52 the optical carriage 58 stops at a prescribed position and reads the document that is being conveyed. It is to be noted that detailed description of the scanner portion has been omitted here.

(Sheet Conveyance Path)

In this embodiment, there are 2 discharge conveyance paths for discharging the sheets to the sheet processing apparatus 300. The first conveyance path 15 subjects the sheet to switch back conveyance in the upper part of the write scanner 14 using the fixing and discharging roller pair 12 and then conveys the sheets in the reverse direction and then discharges them to the sheet processing apparatus 300 and the second conveyance path 30 discharges the sheets from the heat-fixing apparatus 11 directly to the sheet processing apparatus 300.

FIG. 1 shows the sheet S being conveyed on the first conveyance path 15. A FD/FU flapper 21 is provided at the sheet conveyance direction downstream side (simply "downstream" hereinafter) of the fixing and discharging roller pair 12 and it switches the first conveyance path 15 and the second conveyance path 30.

The middle portion of the first conveyance path 15 which is switched by the FD/FU flapper 21 has a merging roller pair 16, and the upper portion of the image forming portion has a reversal roller pair 17 and a drawing conveyance path 18. The reversal roller pair 17 is configured so as to be capable of reversing the sheet conveyance direction and the conveyance path is switched by the reverse flapper 36, and the sheet is conveyed to the third conveyance path 33. The reverse flapper 36 always applies force to the side for closing the first conveyance path 15, and the structure may be such that a mild force is set and it is pressed open by the sheet conveyance force. The structure may also be such that the conveyance path is switched at a prescribed timing by a solenoid or the like.

The third conveyance path 33 is between the reversal roller pair 17 and the discharge roller pair 32, and a conveyance roller pair 34 and a sheet detection sensor 35 are provided at the middle of the third conveyance path 33. In the case where the sheet is discharged to the sheet processing apparatus 300 via the first conveyance path 15 and the third conveyance path 33, the discharging is face down.

The sheet which has been switched by the FD/FU flapper 21 and conveyed by the second conveyance path 30 is directly discharged to the sheet processing apparatus 300 via the discharge roller pair 32. Face up discharge is done in this case.

(Schematic Structure of the Sheet Processing Apparatus)

Figure 2:
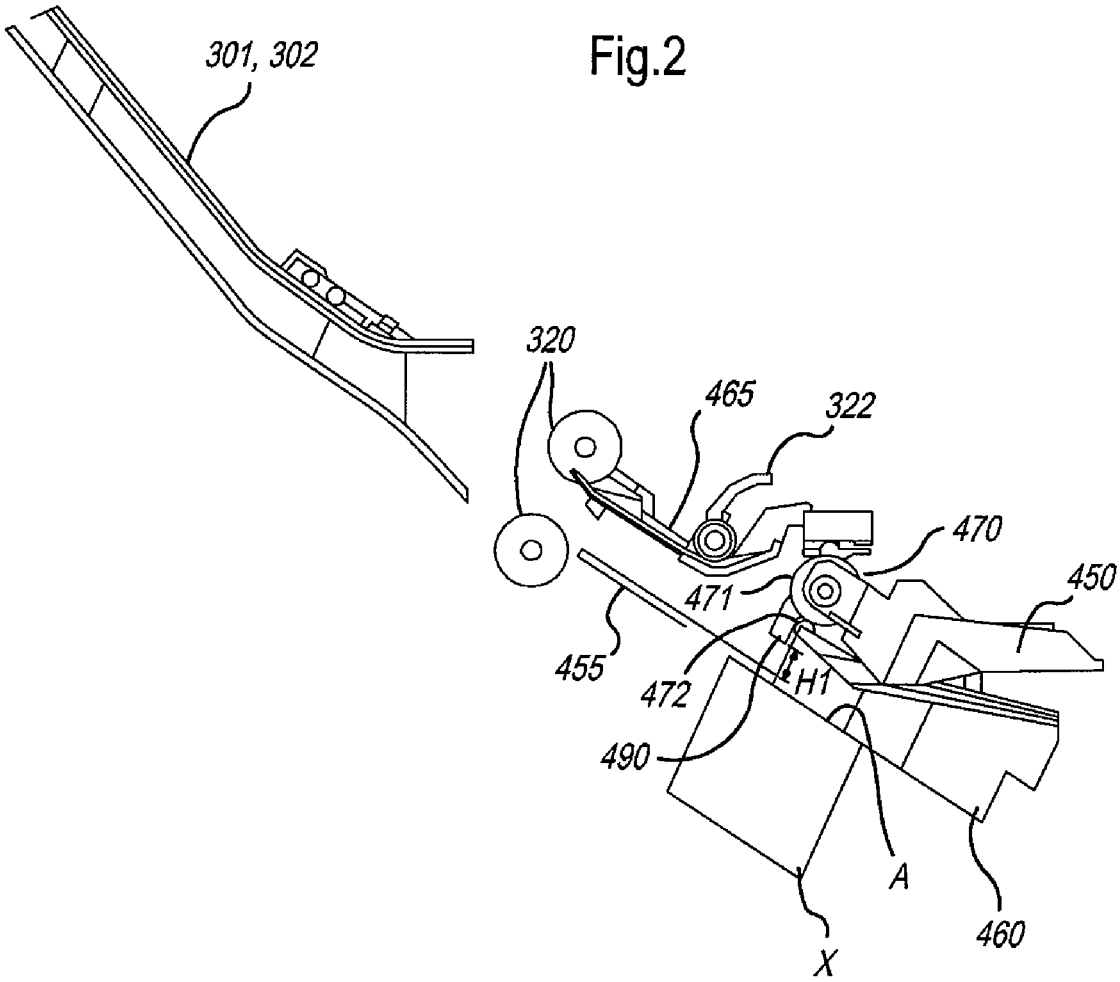
FIG. 2 is a side view for describing the intermediate stacking portion.
Figure 3:
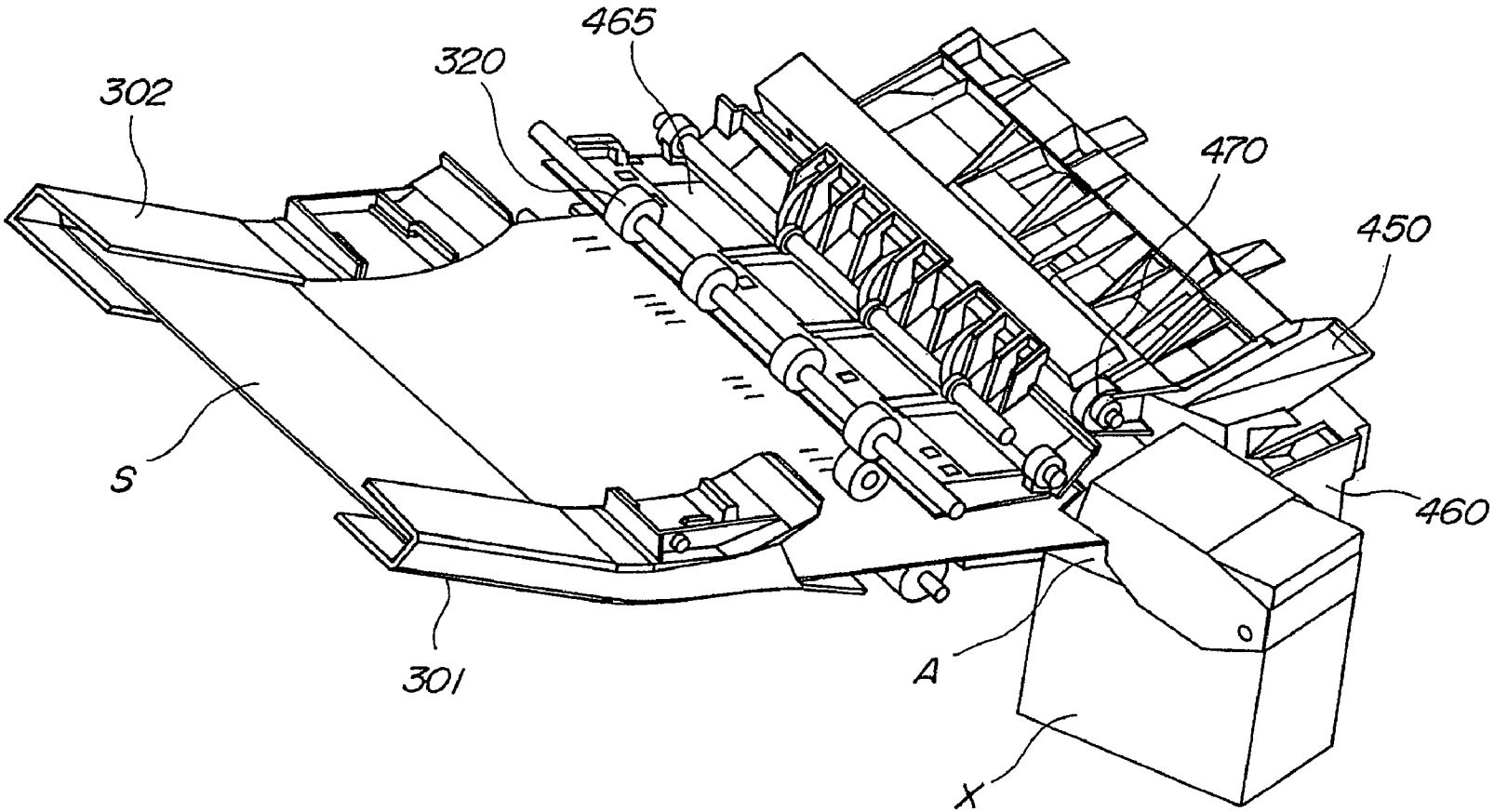
FIG. 3 is a perspective view of the main part for describing the conveyance path.
Figure 4:
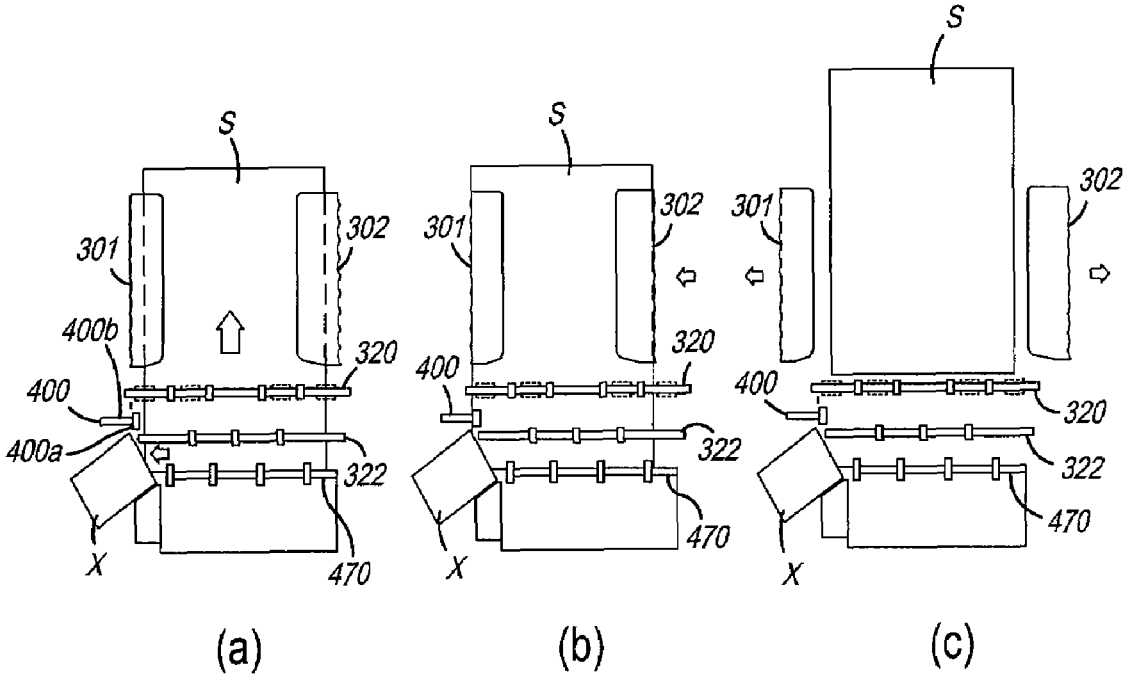
FIG. 4, constituting FIGS. 4(*a*), 4(*b*), and 4(*c*), are plan views for describing the operation of the sheet processing apparatus.
Figure 5:
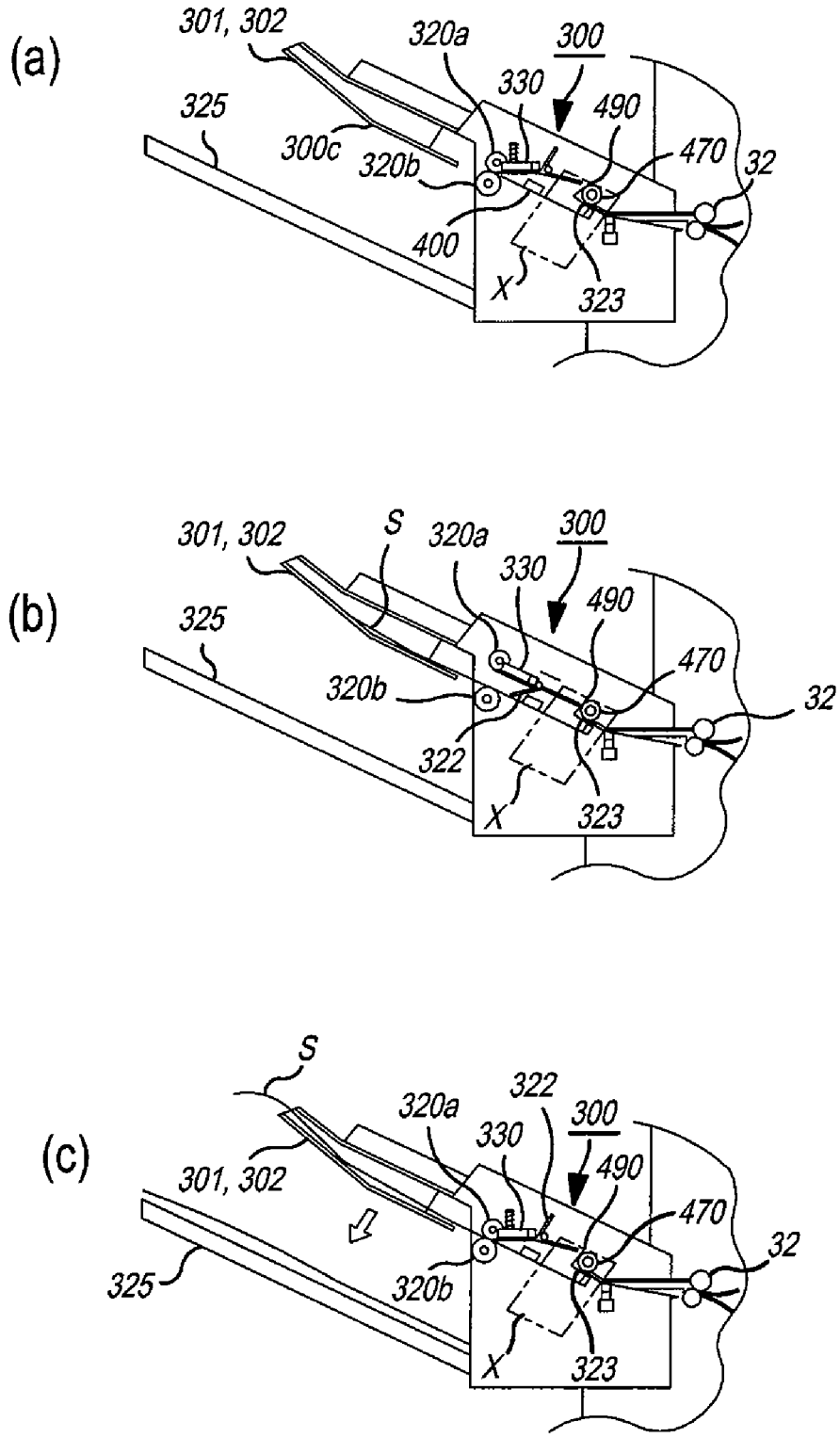
FIG. 5, constituting FIGS. 5(*a*), 5(*b*), and 5(*c*), are side views for describing the operation of the sheet processing apparatus.

Next, the sheet processing apparatus 300 will be described. FIG. 2 is a side view for describing the intermediate stacking portion; FIG. 3 is a main part perspective view for describing the conveyance path; FIG. 4 is a plan view for describing the binding process; and FIG. 5 is a side view for describing the binding process.

As shown in FIG. 1, the sheet processing apparatus 300 comprises a staple roller pair 470 for receiving the sheets conveyed from the image forming apparatus; a discharge roller pair 320 for discharging the sheet bundle; slide guides 301 and 302 for aligning the sheets; and a discharge stacking portion 325 for stacking the sheets that have undergone binding processing. The discharge roller pair 320 can be removed by the arm 330 (See FIG. 5).

As shown in FIG. 2, the intermediate stacking portion has a conveyance path comprising an upper introduction guide 450 which forms a conveyance portion with a staple roller pair 470; an upper guide 465 and a lower guide 455 at a position that is lower than the lower introduction guide 460; and slide guides 301 and 302. A plurality of pressing flags 490*a*-490*c* (See FIG. 8) are provided in the vicinity of the staple roller pair 470 at the downstream side as a pressing means which contacts the upper surface of the sheet discharged from the staple roller pair 470 to the intermediate stacking portion. The pressing flag 490 is a lever member that is attached such that it can swing about one end and is pressed by the sheet being conveyed to swings, but it applies downward force to the sheet due to dead weight or by an elastic member. The lower end (leading end) of the pressing flag 490 is at a lower position than the nip of the staple roller pair 470 and is formed such that the sheet that will be conveyed next does not impact the sheet that has already been stacked. A paddle 322 which contacts the sheet so as hit and pull back the sheet is provided at the downstream side of the pressing flag 490.

As shown in FIG. 3, the slide guides 301 and 302 are two guide members divided in both ends of the sheet width direction, and are moveable in the separation direction by a jogger motor which is not shown (see FIG. 4). The cross section of slide guides 301 and 302 is substantially configured as a square bracket (]) due to a wall portion that guides the side area of the sheet S and a support portion that supports the upper and lower surfaces of the sheet S, and the discharged sheet is supported on the intermediate stacking portion by the lower surface of the above-described configuration, and the central portion in the width direction of the sheet S is not guided. The guide surfaces of the slide guides 301 and 302 herein are inclined at prescribed angles with respect to the horizontal direction and also have a curved portion 300*c* in the middle section. The slide guides 301 and 302 therefore have a steep incline at the downstream side in the direction in which the sheet is conveyed in (leading end side). By providing a bent portion 300*c* at the slide guides 301 and 302 in this manner, curving of the middle part of the sheet S that is not guided at the slide guides 301 and 302 is prevented.

Furthermore, as shown in FIG. 3, the stapler X which is one type of binder is fixed at one side (one side in the direction that intersects the sheet conveyance direction and which is at the left side of the conveyance direction in this embodiment) of the intermediate stacking portion. The stapler X has a structure such that the conveyance path of the intermediate stacking portion passes the opening of the stapler, or in other words, the upper jaw driver (the metal plate that punches out staples) and the lower jaw clincher (bent plate), and in this embodiment, the driver surface A and the lower guide 455 are disposed on substantially the same surface. The driver surface A moves up toward the clincher when a prescribed number of sheets is stacked in the intermediate stacking portion and the binding process is performed. Needless to say, the invention of this application is also effective in a structure which is opposite to that of this embodiment in that the clincher surface is disposed at substantially the same surface as the lower guide 455 and the driver surface is moved downward to perform the binding process. Also, in this embodiment, the upper jaw is the driver and the lower jaw is the clincher, but conversely, the upper jaw may be the clincher and the lower jaw may be the driver. In this embodiment, the binder is explained as a stapler, but the binder could be other kinds of binder, which does not use needles for binding.

In addition, there is a leading upper guide 450 in the vicinity of the stapler X which guides the sheet upper surface between the driver and the clincher of the stapler X. The possible stacking height of the intermediate stacking portion is set in accordance with the nip position from the lower guide 455 to the staple roller pair 470 which is the sheet stacking surface. Meanwhile, because the height of the opening of the stapler X is also set to be substantially the same height as the nip position of the staple roller pair 470, the upper introduction guide 450 is provided at the conveyance direction left side, or in other words only in the vicinity of the stapler X. At this position, the sheet is guided lower than the other parts and the sheet must be guided to the opening of the stapler X.

(Operation of the Sheet Processing Apparatus)

Because the sheet processing apparatus has the above-described structure, the discharge operation can be performed after simply performing the sheet discharge operation and the sheet bundle binding operation.

The discharge operation will be described for simply discharging one sheet at a time to the stacking portion 325. At this time, as shown in FIG. 4, the support portion for supporting the upper and lower surfaces of the sheet S of the slide guides 301 and 302 moves away from the sheet width to the outside position by a prescribed amount. As a result, the slide guides 301 and 302 do not contact nor support the sheet S which is conveyed into the intermediate stacking portion.

In addition, the sheet that is conveyed by the discharge roller pair 32 of the image forming apparatus passes the staple roller pair 470 and the opening of the stapler X and is conveyed by the discharge roller pair 320 and drops down to the stacking portion 325 and is stacked there.

Next the sheet bundle binding process to the discharge operations are described. First as shown in FIG. 4(*a*) and FIG. 5(*a*), a sheet is conveyed to the intermediate stacking portion. At this time, as shown in FIG. 4(*a*), the position of the slide guides 301 and 302 is adjusted in accordance with the width of the conveyed sheet and is at a position that is a wider than the width of the sheet S by a prescribed amount (called holding position hereinafter). More specifically, the wall portion which guides the side area of the sheet S is at a position which is separated by a prescribed distance more than the sheet width and the support section supports the lower surface of the sheet S is positioned at distance which is less that sheet width. As a result, the upper guide 465 and the lower guide 455 together form the conveyance path of the intermediate stacking portion. Also, as shown in FIG. 5(*a*), the pressing flags 490 which are provided at the downstream side of the staple roller pair 470 are pressed by the sheet to be conveyed and swung upwards.

The sheet which is conveyed in by the discharge roller pair 32 of the image forming apparatus is guided by the upper introduction guide 450 such that the end at the stapler X side is below the other portions, and is conveyed by the staple roller pair 470 to pass the opening of the stapler X. Next, the sheet is conveyed by the discharge roller pair 320 and conveyed above the guide surface of the guide that comprises the slide guides 301 and 302.

Next, as shown in FIG. 5(*b*), the arm 330 is swung in the clockwise direction in the drawing and as a result, the upper roller 320*a* of the discharge roller pair 320 which is supported on the arm 330 moves away in the upper direction, and the discharge roller pair 320 is separated. At the same time, the drive which is connected to the discharge roller pair 320 is disconnected and the rotation of the upper roller 320*a* and the lower roller 320*b* is stopped. As a result, when the rear end of the sheet is completely moved away from the staple roller pair 470, the sheet S returns in the direction opposite to the conveyance direction due to dead weight in the reference wall 323 direction. At this time, because the pressing flag 490 is applying a force to the sheet rear end and the sheet rear end is pressed by the pressing flag 490 and the sheet quickly falls and the rear end height of the stacked sheet bundle is thereby limited.

Next, as shown in FIG. 4, only the slide guide 302 which is at the right side of the drawing is actuated, and the aligning of the width direction of the sheet S that has been stacked in the intermediate stacking portion begins. More specifically, the slide guide 302 is driven by the motor M and by moving to the left side in the drawing, the wall portion of the slide guide 302 contacts the right side surface of the sheet S, and the sheet S is pushed by the slide guide 301. The left side surface of the sheet S then comes against the wall portion of the slide guide 301 and aligning of the sheet in the width direction is thereby performed. At the position where the sheet is aligned, the sheet S is set so as to move to the set staple position. After the aligning operation, the slide guide 302 moves towards a direction that is wider than the width of the sheet S and prepares for next sheet that is conveyed at the holding position.

When the slide guides 301 and 302 move away to the holding position, the restriction in the alignment direction of the sheet S is released and the sheet S is now in a moveable state. At this time, as shown in FIG. 5(*b*), the paddle 322 makes one revolution while being caused to contact the upper surface of the sheet S, and the sheet S is pulled back toward the reference wall 323. Sheet alignment in the conveyance direction and the width direction are possible as a result of these operations.

It is to be noted that, in order to maintain the aligned state, a stamping means 400 is provided for pressing on the sheet S that has been aligned as shown in FIG. 4. The stamping means 400 is configured such that a lever 400*b* that has a friction member 400*a* can move up and down, and after the aligning operation is complete, it moves downward and presses on the upper surface of the sheet, and this prevents the sheets that are already stacked from becoming misaligned by the next sheet to come in.

The stacking and alignment operation described above are done for a prescribed number of sheets, and as shown in FIG. 4(*b*), a binding process using the stapler X which is positioned at the left side of the rear end of the sheet bundle is performed with the width direction of the sheet bundle in a restricted state due to the slide guide 301 and the slide guide 302. According to this configuration and operation, during the aligning operation for each sheet, the slide guide 301 is stopped at the reference position and does not move, and only the slide guide 302 moves and performs the alignment. As a result, the left side ends of the sheets are lined up at the reference position and accurate binding process is ensured. The binding process is done by the stapler X which is fixed at the slide guide 301 side which is the reference point.

When the binding process is complete, as shown in FIG. 5(*c*), the arm 330 rotates in the counterclockwise direction in the drawing and the upper roller 320*a* is thereby moved in the downward direction. The discharge roller pair 320 comprises an upper roller 320*a* and a lower roller 320*b* which nip the sheet bundle. The discharge roller pair 320 is then driven by rotation and the sheet bundle is conveyed toward the slide guide 301 and the slide guide 302. When the rear end of the sheet bundle S is completely moved away from the discharge roller pair 320, as shown in FIG. 4(*c*), the slide guides 301 and 302 move in the expansion direction. When the interval between the slide guides 301 and 302 is about the width of the sheet or wider than the width of the sheet, the stapled sheet bundle which is supported on the slide guides 301 and 302 falls to below as shown in FIG. 5(*c*) and is stacked in the discharge stacking portion 325. The above is a description of the configuration and the set of operations of the printer main body and the sheet processing apparatus of this embodiment.

(Structural Features of the Invention)

Figure 6:
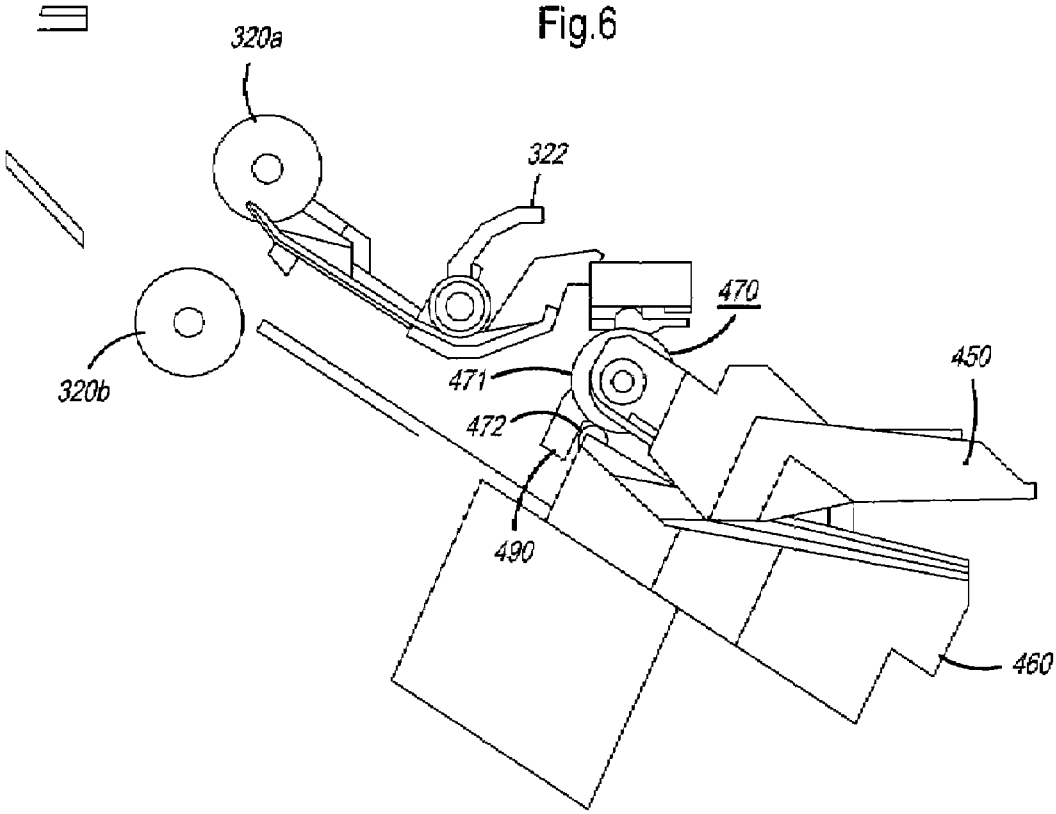
FIG. 6 is a side view of the main parts of the sheet processing apparatus.
Figure 7:
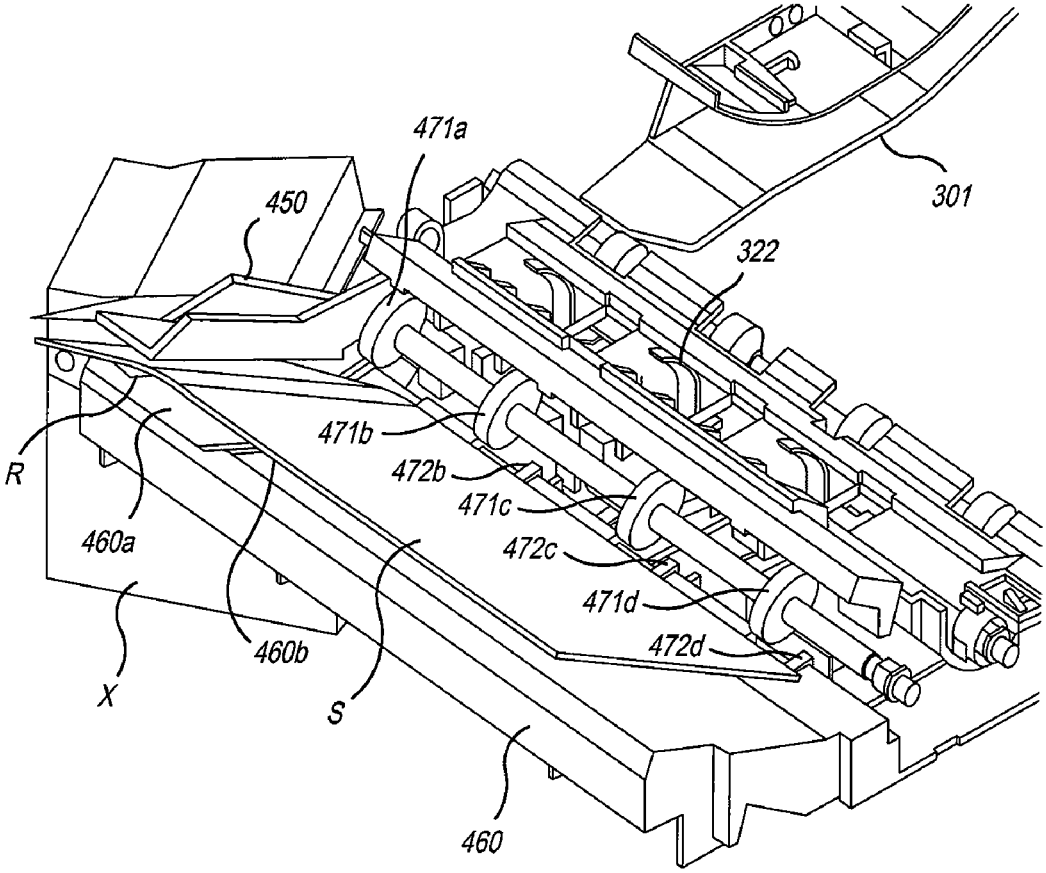
FIG. 7 is a perspective view of the intermediate stacking portion from the upstream side of the sheet processing apparatus.
Figure 8:
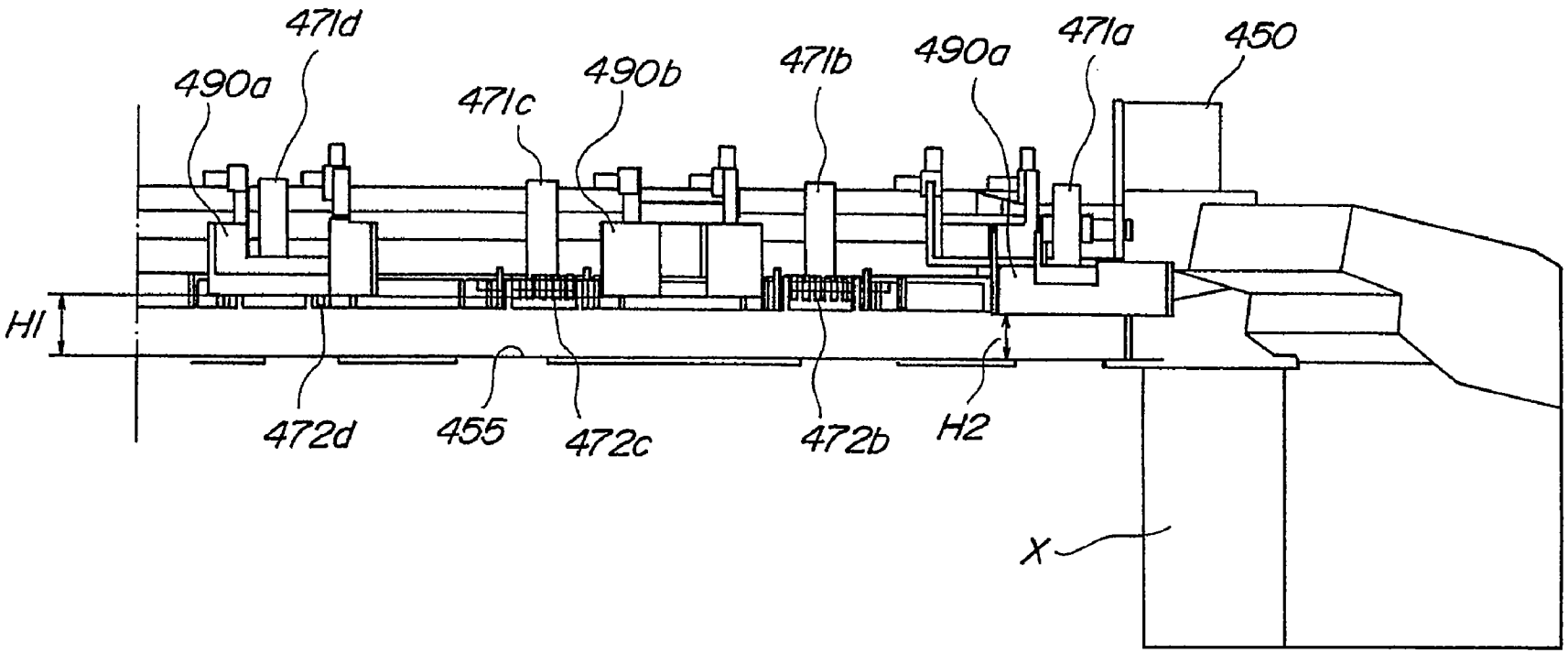
FIG. 8 is a view of the main parts of the sheet processing apparatus from the downstream side.

Next the structural features of the sheet processing apparatus of the present invention will be described. FIG. 6 is a side view of the main parts of the sheet processing apparatus; FIG. 7 is perspective view of the intermediate stacking portion from the upstream side of the sheet processing apparatus; FIG. 8 is a view of the main parts of the sheet processing apparatus from the downstream side; and FIG. 9 is a side view for describing the operation of the pressing flags.

As shown in FIG. 7 or FIG. 4, a plurality of roller pairs 470 are disposed in the sheet width direction (direction intersecting the sheet conveyance direction), and as a rule, they are formed of a drive roller 471 (471*a-d*) which comprise a frictional member such as a rubber member or the like and a driven roller 472 (472*a-d*). The driven roller (472*a-d*) is applied with a force toward the drive roller 471*a-d* by an elastic member such as a spring or the like which is not shown.

In this embodiment, as shown in FIG. 6 and FIG. 7, only the drive roller 471*a*, and not the driven roller, is provided in the area adjacent to the stapler X. That is to say, in the structure in which the stapler X is disposed at the left side end in the conveyance direction, the driven roller which forms a pair with the drive roller 471*a* which is disposed at the leftmost side (the drive roller that is closest to the stapler X) is not disposed to face said drive roller but the driven rollers 472*b*-472*d* which form pairs with the other drive rollers 471*b*-471*d* are provided.

Figure 9:
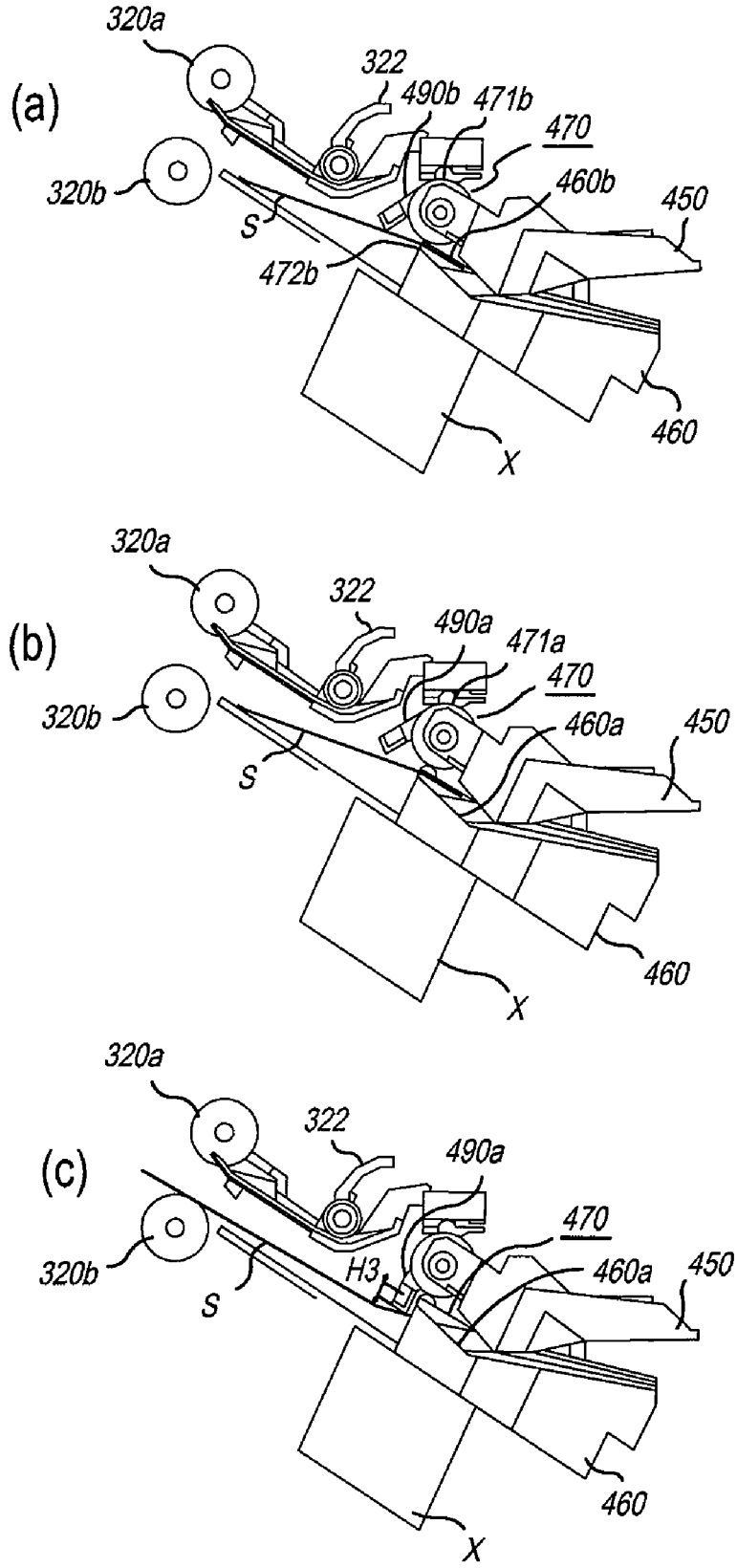
FIG. 9, constituting FIGS. 9(*a*), 9(*b*), and 9(*c*), are side views for explaining the operation of the pressing flag.

In addition, the portion 460*a* of the guide surfaces of the lower introduction guide 460 that has the upper introduction guide 450 that guides the sheet end to the opening of the stapler X is formed lower than the other portion 460*b* (see FIG. 9 (*a*)). However, the low portion 460*a* of the lower introduction guide 460 is higher than the driver surface A of the stapler X, so that the leading end of guided sheet S and the opening of the staple X do not interfere with each other.

Furthermore, as shown in FIG. 8, of the pressing flags 490*a*-490*c*, the pressing flag 490*a* which is closest to the stapler X is formed so as to be longer than the other pressing flags 490*b* and 490*c*. That is to say, at the region corresponding to the drive roller 471*a* which does not have the opposing driven rollers, the pressing flags 490 restricts the sheet S to a position lower than the region corresponding to the drive rollers 471*b*-471*d* which have the opposing driven rollers.

As shown in FIG. 2, the interval between the lower guide 455 and the pressing flags 490 is that of a sheet bundle thickness (alignment height H1) for which alignment or binding processing is possible in the intermediate stacking portion. In the structure in the sheet S is passed by the opening of the stapler, in order for the binding process to be carried out with good alignment for a large sheet bundle by a small stapler that is of low cost, the alignment height H1 must be increased in order to reduce the alignment time in the sheet conveyance direction and the sheet width direction. In order to increase the alignment height H1, the staple roller pair 470 must be provided at a high position with respect to the sheet stacking surface of the lower guide 455.

In the case where the pressing flag 490*a* which is closest to the stapler X is made longer as shown in this embodiment, the alignment height H2 which is determined by the pressing flag 490*a* has the maximum alignment height. It is to be noted that the alignment heights H1 and H2 are set to a height that is less by a predetermined amount than that of the angle portion of the lower introduction guide 460 (in the driven roller 472 vicinity). However, because the low portion 460*a* of the lower introduction guide 460 must be lower than the upper end surface of the opening of the stapler X, so that the leading end of guided sheet S and the stapler X do not interfere with each other, the alignment height H2 of the pressing flag 490*a* is, to some extent, indirectly determined by the sheet stacking surface of the lower guide 455. Even in this case, the adjusting height H1 of the other portion is high, conveyance resistance is thereby reduced and when the thickness of the sheet bundle is large, such as when there are a large number of sheets or for the binding process for thick paper in particular, alignment is improved in the direction of sheet conveyance by the paddle and in the direction of sheet conveyance and the direction perpendicular thereto by the slide guide.

It is to be noted that there is a tendency for the difference in conveyance resistance in direction perpendicular to the sheet conveyance direction for introducing the sheet into the opening of the stapler X to increase as the difference between H1 and H2 increases. In particular, thick paper which is rigid sometimes advances on an incline, or paper jamming may occur because the paper is not conveyed. In other words, even if the alignment properties of normal paper are improved, sometimes there is the problem that the sheet cannot be completely aligned due inclined conveyance in the case of thick paper. As a result, in this embodiment, a driven roller which opposes the drive roller 471*a* provided in the vicinity of stapler X is not provided and because a low portion 460*a* is formed at the lower introduction guide 460 below the drive roller 471*a*, even for thick paper, the length of the free end at the stapler X side in the sheet conveyance direction and in the perpendicular direction can be made larger, and the difference in the conveyance resistance is prevented from getting larger. It is to be noted that in this example, the driven roller is not provided for the drive roller 471*a* only, but in order to further reduce the conveyance resistance, drive rollers 471 that do not have the driven rollers may be disposed at a plurality of locations as long as the conveyance ability does not decrease.

Due to the above-described structure, the left side end in the conveyance direction of the sheet that is conveyed from the discharge rollers 320 of the image forming apparatus to the sheet processing apparatus 300 is guided to the opening of the stapler X by the upper introduction guide 450 and the low portion 460*a* of the lower introduction guide 460 and then introduced into the discharge roller pair 320.

At this time, as shown in FIG. 7, the stapler X side end of the sheet is bent downwards by the upper introduction guide 450. However, at the position corresponding the drive roller 471*a*, because there is no opposing driven roller, the free end length becomes longer in the sheet conveyance direction from the nip position of the drive roller 471*b* and the driven roller 472*b* to the stapler X side of the sheet, and the rigidity of the curved sheet end is less than when the driven roller is provided. Thus, even when thick rigid paper is being conveyed, the conveyance resistance due to the friction between the sheet end at the stapler X side and the upper introduction guide 450 can be reduced. It is to be noted that the drive roller 471*a* that does not have the opposing driven roller also functions to guide the upper surface of the sheet when the sheet passes the staple roller pair 470, and it contacts the sheet S in accordance with the orientation and rigidity of the sheet.

The sheet which has been removed from the staple roller pair 470 swings the pressing flags 490*a*-490*c*. FIG. 9(*a*) is a cross-sectional view of the high portion 460*b* of the lower introduction guide 460 (the portion other than that in the vicinity of stapler X), and is a portion that corresponds to the drive rollers 471*b*-471*d*. FIG. 9(*b*) is a cross-sectional view of the low portion 460*a* of the lower introduction guide 460 (in the vicinity of stapler X), and is a portion that corresponds to the drive roller 471*a* which does not have an opposing driven roller. By not providing the driven roller, and by not only providing the low portion on the lower introduction guide 460 but also forming said portion of the pressing flag 490*a* to be long, low conveyance of the stapler X side end of the sheet can be ensured and the sheet will be guided to the opening of the stapler X.

As shown in FIG. 9(*c*), when the end of the sheet is removed from the staple roller pair 470, the pressing flags 490 swing in the counterclockwise direction of the drawing and stop at a prescribed position and the height of the sheet end is limited. Because the rear end of the preceding sheet is restricted to a lower position than the position at which the next sheet comes in, the next sheet is preventing from slipping under the preceding sheet when it comes in. At this time also, because the pressing flag 490*a* is formed to be long, the next sheet is preventing from slipping under the preceding sheet due to the difference in height H3 between the low portion 460*a* of the lower introduction guide 460.

In this manner, even in a stapling job for thick paper sheets do not advance on an incline and even if the number of sheets for binding is large, because sufficient loading height H1 is secured, a sheet processing apparatus can be provided in which a small and inexpensive stapler is used, and alignment properties are good.

Embodiment 2

Figure 10:
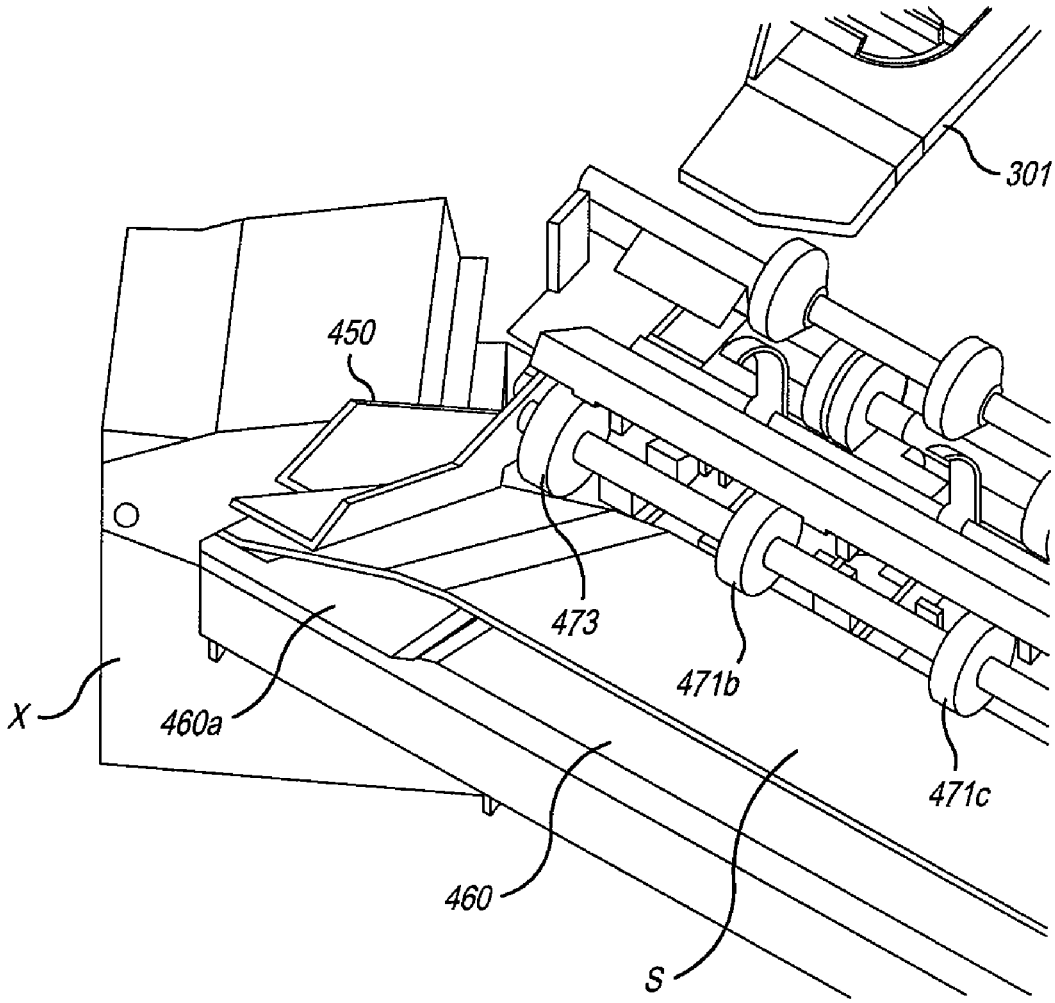
FIG. 10 is a perspective view of the intermediate stacking portion of the second embodiment from the upstream side of the sheet processing apparatus.

Embodiment 2 of the sheet processing apparatus and the image forming apparatus of the present invention will be described using the drawings. FIG. 10 is a perspective view of the intermediate stacking portion from the upstream side of the sheet processing apparatus, and the parts which are the same as those of embodiment 1 have been assigned the same reference numbers and descriptions thereof have been omitted.

In embodiment 1, the difference in configuration between the drive roller 471*a* which does not have an opposing driven roller and the other drive rollers 471*b*-471*d* was not described. As a result, in embodiment 1, depending on the orientation and rigidity of the sheet, the sheet would contact the drive roller 471*a* some times and not contact it at other times. More specifically, in some cases a thin sheet which is not rigid does not contact the drive roller 471*a* because of flexing, while thick paper which is rigid makes contact. Also even in the case where there is contact, the contact force is not sufficient to transmit the conveyance force.

As a result, in this embodiment, the drive roller 473 which does not have an opposing driven roller has a larger diameter than the other drive rollers 471*b*-471*d*. Thus, the drive roller 473 can more forcefully contact the sheet and can transmit conveyance force to the sheet. Accordingly, even in the case where the sheet receives conveyance resistance due to the upper introduction guide 450, because conveyance force can be provided in that vicinity, advancing on an incline and paper jams can be prevented even for thicker and more rigid sheets. It is to be noted that in this embodiment, by increasing the diameter of the drive roller 473 which does not have an opposing driven roller, the drive roller 473 contacts the sheet more forcefully, but the same effect can be obtained by leaving the other drive rollers 471*b*-471*d* with the same diameter and lowering their installation position, and causing the roller surface to contact the sheet a position that is lower than the other drive rollers 471*b*-471*d*.

Embodiment 3

Figure 11:
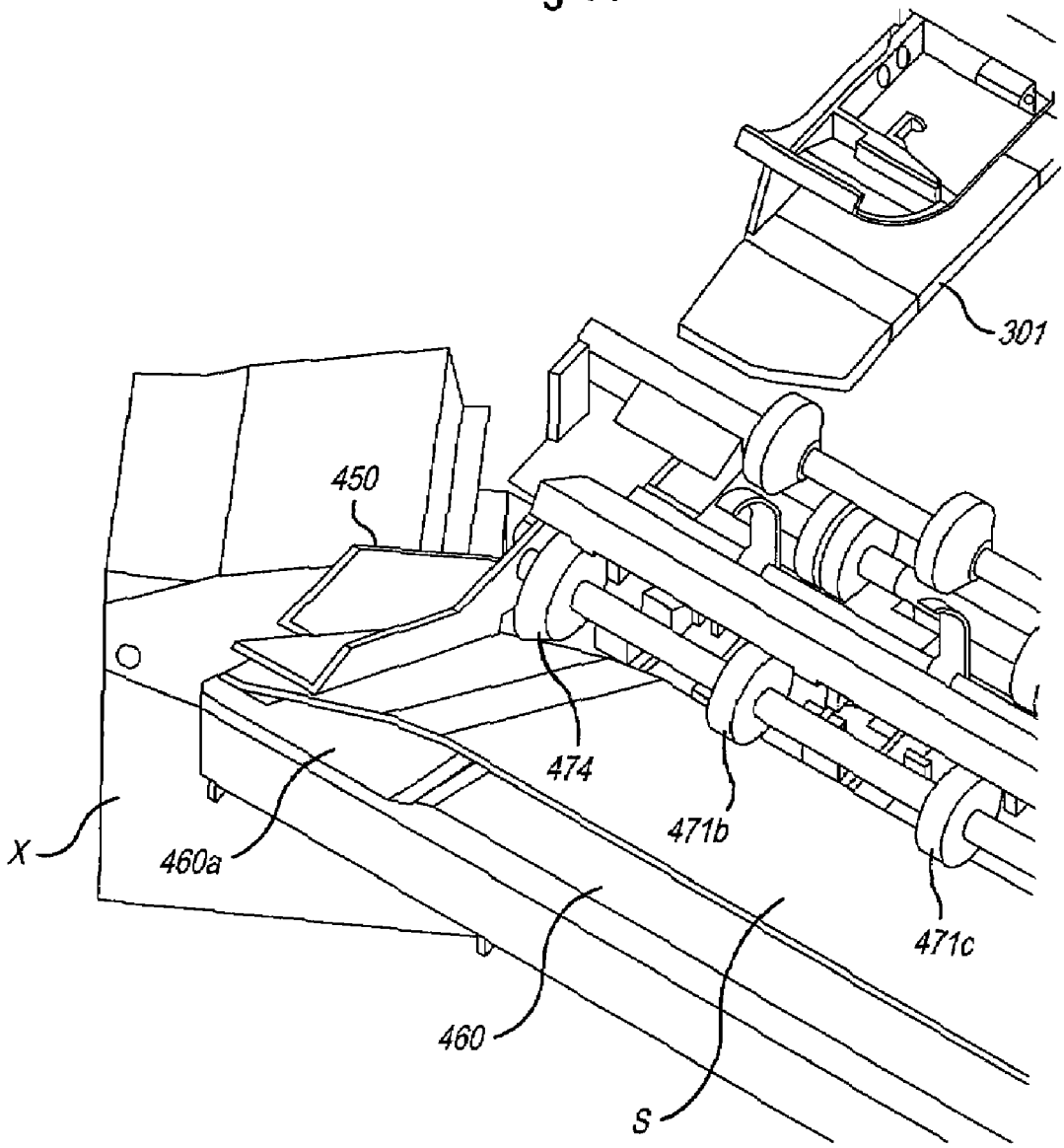
FIG. 11 is a perspective view of the intermediate stacking portion of the third embodiment from the upstream side of the sheet processing apparatus.

Embodiment 3 of the sheet processing apparatus and the image forming apparatus of the present invention will be described using the drawings. FIG. 11 is a perspective view of the intermediate stacking portion from the upstream side of the sheet processing apparatus, and the parts which are the same as those of embodiment 1 have been assigned the same numbers and descriptions thereof have been omitted.

As shown in FIG. 11, in this embodiment, while the other drive rollers 471*b*-471*d* have a cylindrical configuration, the drive roller 474 which does not have an opposing driven roller has a tapered configuration such that the diameter at the stapler X side is larger than the diameter at the opposite side (the diameter gets larger as the outside of the sheet is approached).

The drive roller 474 whose diameter has been changed in this manner, as is the case in embodiment 2, can more forcefully contact even a bent sheet and can transmit conveyance force to the sheet. Also because the curve ratio R of a curved sheet can be adjusted more than in the case of the configuration of embodiment 1, more stable sheet conveyance is possible and inclining and paper jams can be prevented even for thicker and more rigid sheets.

Embodiment 4

Figure 12:
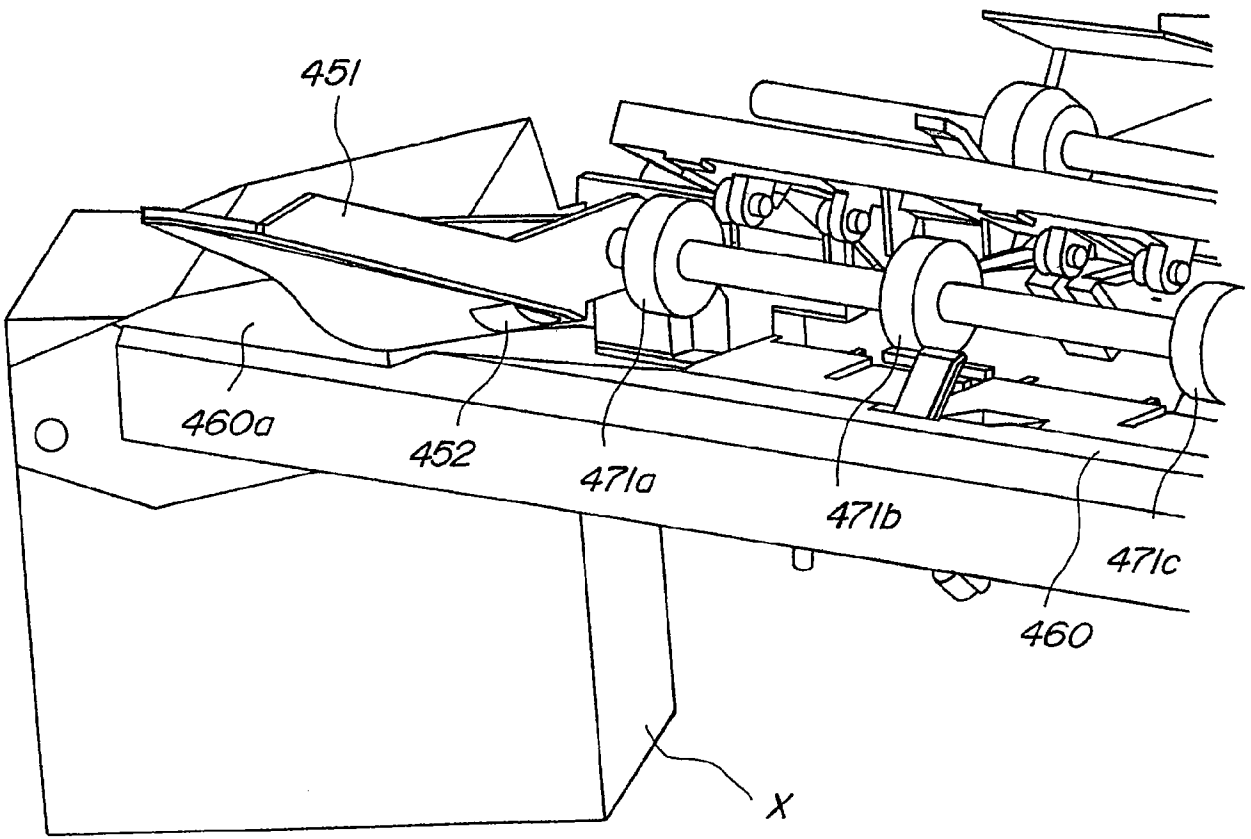
FIG. 12 is a perspective view of the intermediate stacking portion of the fourth embodiment from the upstream side of the sheet processing apparatus.

Embodiment 4 of the sheet processing apparatus and the image forming apparatus of the present invention will be described using the drawings. FIG. 12 is a perspective view of the intermediate stacking portion from the upstream side of the sheet processing apparatus, and the parts which are the same as those of embodiment 1 have been assigned the same numbers and descriptions thereof have been omitted.

As shown in FIG. 12, in this embodiment, the upper introduction guide 451 which guides the sheet end to the stapler X has a rotatable roller 452. Also when compared to the upper introduction guide 450 described in embodiment 1, the configuration of the upper introduction guide 451 is changed so as to have an opening portion and a rotational axis because the roller 452 was provided.

As a result, because the sheet which slides on the upper introduction guide 451 is guided by the roller 452, the sheet conveyance resistance can be significantly reduced. Thus advancing on an incline and paper jamming is also prevented when a thick sheet or a rigid sheet is being conveyed.

It is to be noted it is sufficient for the roller to be provided in the region where the driven roller from the conveyance roller pair is not provided, and the roller may be provided not only in the vicinity of upper introduction guide 451 but also in the vicinity of upper guide 465 or drive roller 471*a*.

This application claims priority from Japanese Patent Application No. 2004-44842 filed Feb. 20, 2004, which is hereby incorporated by reference herein.

What is claimed is:

1. A sheet processing apparatus comprising:

a conveyance portion which includes a plurality of drive portions which convey a sheet, and are disposed in a direction that intersects a sheet conveyance direction;

a stacking portion on which sheets conveyed by the conveyance portion are stacked;

a binder which has an opening formed between an upper jaw and a lower jaw, and in which one of the upper jaw and the lower jaw is moved toward the other to perform a binding process for binding the sheets stacked in the stacking portion, wherein the opening of the binder is positioned at one side of the stacking portion in the direction which intersects the sheet conveyance direction, such that the sheet which is conveyed to the stacking portion by the conveyance portion passes through the opening of the binder; and a plurality of pressing members which restrict the height of the sheets stacked on the stacking portion, wherein a first drive portion of the plurality of drive portions, which is closest to the opening of the binder, is a single conveyance roller configured to guide the sheet toward the opening of the binder, and wherein a second drive portion of the plurality of drive portions is a conveyance roller pair, wherein the plurality of pressing members restrict the sheets at the lower side than the nip of the conveyance roller pair, and wherein a pressing member closest to the binder performs restriction at a position lower than other pressing members of said plurality of pressing members.

2. The sheet processing apparatus of claim 1, further comprising:

a guide which guides an end of the sheet towards the opening of the binder, wherein the guide includes an upper introduction guide member which guides an upper surface of the sheet, and wherein the upper introduction guide member guides a sheet end at a binder side downwards towards the opening of the binder.

3. The sheet processing apparatus of claim 2, wherein the guide includes a lower introduction guide member which guides a lower surface of the sheet, and wherein the guide surface of the lower introduction guide member is formed such that a region opposing the upper introduction guide member is lower than the other region of the guide surface of the lower introduction guide member.

4. A sheet processing apparatus comprising:

a conveyance portion which includes a plurality of drive portions which convey the sheet, and are disposed in a direction that intersects a sheet conveyance direction;

a stacking portion on which the sheets conveyed by the conveyance portion are stacked;

a binder which has an opening formed between an upper jaw and a lower jaw and in which one of the upper jaw and the lower jaw is moved toward the other to perform a binding process for binding the sheets stacked in the stacking portion, wherein the opening of the binder is positioned at one side of the stacking portion in the direction which intersects the sheet conveyance direction, such that the sheet which is conveyed to the stacking portion by the conveyance portion passes through the opening of the binder; and a guide which guides an end of the sheet towards the opening of the binder, wherein a first drive portion of the plurality of drive portions, which is closest to the opening of the binder, is different from a second drive portion of the plurality of drive portions and is configured to guide the sheet toward the opening of the binder, wherein the guide includes an upper introduction guide member, which guides an upper surface of the sheet, guides a sheet end at a binder side downwards towards the opening of the binder, and a rotatable member.

5. The sheet processing apparatus of claim 4, wherein the guide includes a lower introduction guide member which guides a lower surface of the sheet, and wherein the guide surface of the lower introduction guide member is formed such that a region opposing the upper introduction guide member is lower than the other region of the guide surface of the lower introduction guide member.

* * * * *